US011426000B2

(12) United States Patent
Klacking

(10) Patent No.: US 11,426,000 B2
(45) Date of Patent: Aug. 30, 2022

(54) PROTECTIVE DEVICE FOR FIXTURES

(71) Applicant: Ryan Joseph Klacking, Dearborn, MI (US)

(72) Inventor: Ryan Joseph Klacking, Dearborn, MI (US)

(73) Assignee: Ryan Joseph Klacking, Dearborn, MI (US)

( * ) Notice: Subject to any disclaimer, the term of this patent is extended or adjusted under 35 U.S.C. 154(b) by 755 days.

(21) Appl. No.: 15/215,135

(22) Filed: Jul. 20, 2016

(65) Prior Publication Data

US 2017/0127832 A1 May 11, 2017

Related U.S. Application Data

(60) Provisional application No. 62/194,565, filed on Jul. 20, 2015.

(51) Int. Cl.

| | |
|---|---|
| ***A47B 97/00*** | (2006.01) |
| ***E04G 21/24*** | (2006.01) |
| ***A47L 11/00*** | (2006.01) |

(52) U.S. Cl.

CPC ..... *A47B 97/00* (2013.01); *A47L 11/00* (2013.01); *E04G 21/24* (2013.01)

(58) Field of Classification Search

CPC ..... A47B 97/00; A47B 96/20; E04G 21/24; A47F 5/004; Y10T 428/24008

USPC ..... 74/551.8, 551.9; 156/577, 579

See application file for complete search history.

(56) References Cited

U.S. PATENT DOCUMENTS

| | | | | |
|---|---|---|---|---|
| 3,672,424 | A * | 6/1972 | Brown | E06B 3/481 49/495.1 |
| 3,871,940 | A * | 3/1975 | Antonioni | B05C 9/10 156/577 |
| 3,889,408 | A * | 6/1975 | Offner | G09F 3/20 40/661.03 |
| 4,344,367 | A * | 8/1982 | Meri | A47B 57/04 108/1 |
| 4,606,170 | A * | 8/1986 | Mendenhall | A47B 95/043 52/800.1 |
| 5,176,435 | A * | 1/1993 | Pipkens | A47B 17/00 312/265.6 |
| 5,271,634 | A * | 12/1993 | Walton | B62B 3/1436 160/23.1 |
| 5,411,231 | A * | 5/1995 | Buck | H01F 7/0252 248/206.5 |

(Continued)

FOREIGN PATENT DOCUMENTS

| | | | |
|---|---|---|---|
| WO | 2014076334 A1 | 5/2014 | |
| WO | WO-2014076334 A1 * | 5/2014 | E01F 15/141 |

OTHER PUBLICATIONS

Definition of Cart (Year: 2018).*

*Primary Examiner* — Travis M Figg

(74) *Attorney, Agent, or Firm* — Carlson, Gaskey & Olds, P.C.

(57) ABSTRACT

A protective strip for protecting a fixture includes a piece of flexible material having a first edge and a second edge, and a plurality of magnets spaced along the first edge. In another example, a system for protecting a fixture includes a protective strip having a plurality of magnets spaced along a first edge, and a cart. The cart has a vertical member configured to hold the protective strip when the protective strip is rolled. A method is also disclosed.

14 Claims, 5 Drawing Sheets

(56) References Cited

U.S. PATENT DOCUMENTS 5,415,301 A * 5/1995 Bruton ..... A47B 96/1416 211/183
5,647,182 A * 7/1997 Rutherford ..... E04F 19/028 52/287.1
5,799,921 A * 9/1998 Stattel ..... A47B 97/00 248/501
5,865,943 A * 2/1999 Marty ..... B65H 37/04 156/577
6,036,292 A * 3/2000 Mandel ..... F25D 23/062 312/401
6,066,383 A * 5/2000 Smith ..... A47B 5/006 52/287.1
6,109,458 A * 8/2000 Walsh ..... A47F 1/126 211/59.3
6,644,609 B1 * 11/2003 Scott ..... A47B 96/1458 248/909
6,871,923 B2 * 3/2005 Dietz ..... F25D 25/02 312/410
8,029,895 B1 * 10/2011 Heysek ..... B44D 3/225 428/354
8,689,852 B2 4/2014 Roth et al.
8,820,382 B1 * 9/2014 Renkert ..... B65H 35/0033 156/577
2003/0094243 A1 * 5/2003 Charriere ..... B65H 35/0033 156/577
2004/0006902 A1 * 1/2004 Zarelius ..... G09F 7/04 40/605
2004/0056575 A1 * 3/2004 Dietz ..... F25D 25/02 108/27
2004/0200559 A1 * 10/2004 Richards ..... B65H 35/0033 156/574
2006/0006969 A1 * 1/2006 Cassar ..... H01F 7/0215 335/306
2008/0217505 A1 * 9/2008 Cohoon ..... E04F 19/04 248/683
2009/0272497 A1 * 11/2009 Pyles ..... B65H 35/0033 156/523
2010/0209655 A1 * 8/2010 Brannan ..... F25D 25/02 428/137
2012/0037048 A1 * 2/2012 Brenner ..... A47B 96/00 108/27
2013/0112355 A1 * 5/2013 Roth ..... A47H 23/00 160/127
2014/0144964 A1 * 5/2014 Chandaria ..... B65H 35/0026 242/562
2014/0251560 A1 9/2014 Roth et al.
2014/0352106 A1 12/2014 King, Jr.
2017/0127832 A1 * 5/2017 Klacking ..... A47L 11/00

* cited by examiner

PROTECTIVE DEVICE FOR FIXTURES

BACKGROUND

Many retail stores and industrial buildings have fixtures on the floor. An example of such a fixture is a shelving unit used to store and display retail merchandise, such as a gondola shelving unit. An exemplary shelving unit is illustrated in FIG. 1. The shelving unit 20 has a vertical back panel 22, at least one shelf 24, a base deck 26, and a base 28.

Many of these retail stores also have floors that require periodic maintenance. For example, concrete floors may require cleaning, polishing, stripping and waxing. Often, large, bulky machines are used to maintain these floors. When these machines bump into fixtures, such as gondola shelving units, they can leave dents and scratches, which may diminish the aesthetic appeal of the shelving display or other fixture.

Typically, the person that is maintaining the floors will take measures to protect the shelving systems. One known method of protecting fixtures is applying tape around the bottom of the fixture. Another known method of protecting fixtures is attaching a protective material to the lowest shelf using clips. These processes are time consuming.

SUMMARY

A protective strip for protecting a fixture includes a piece of flexible material having a first edge and a second edge, and a plurality of magnets spaced along the first edge. In another example, a system for protecting a fixture includes a protective strip having a plurality of magnets spaced along a first edge, and a cart. The cart has a vertical member configured to hold the protective strip when the protective strip is rolled. A method is also disclosed.

The various features and advantages of this invention will become apparent to those skilled in the art from the following detailed description of an embodiment. The drawings that accompany the detailed description can be briefly described as follows.

DETAILED DESCRIPTION

Figure 1:
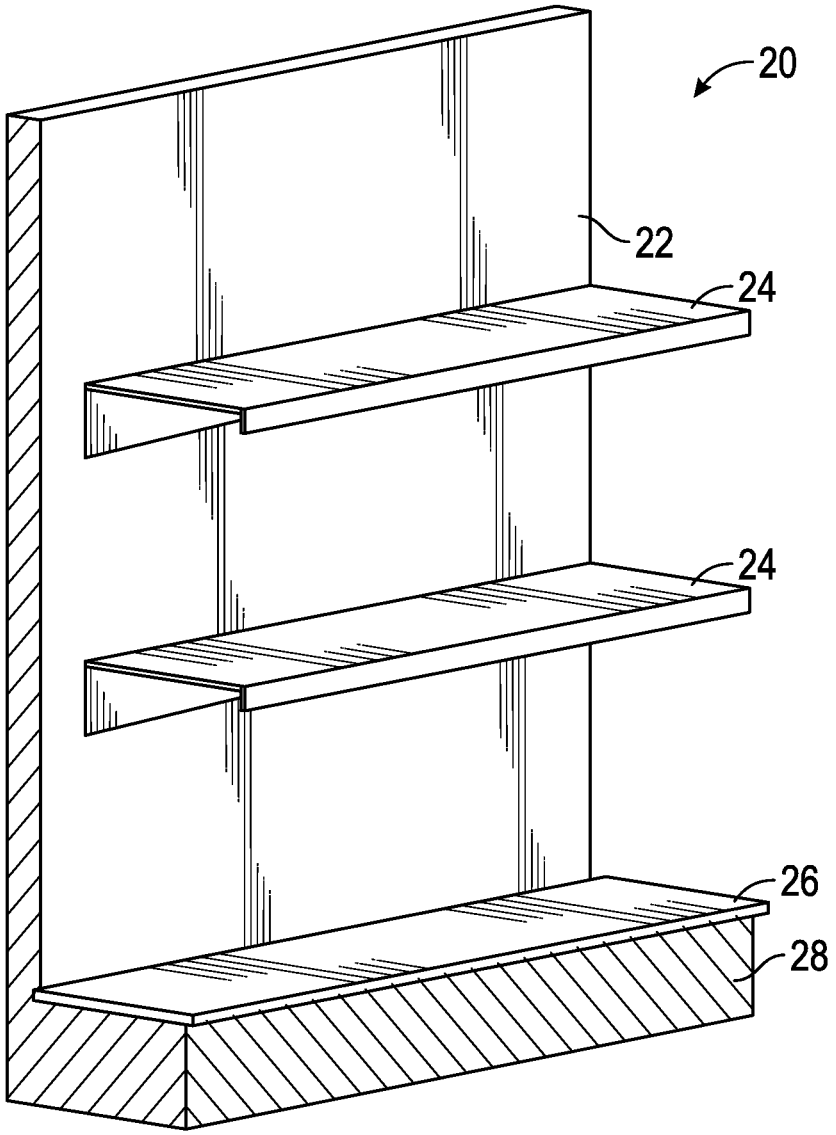
FIG. 1 illustrates an exemplary shelving structure.
Figure 2:
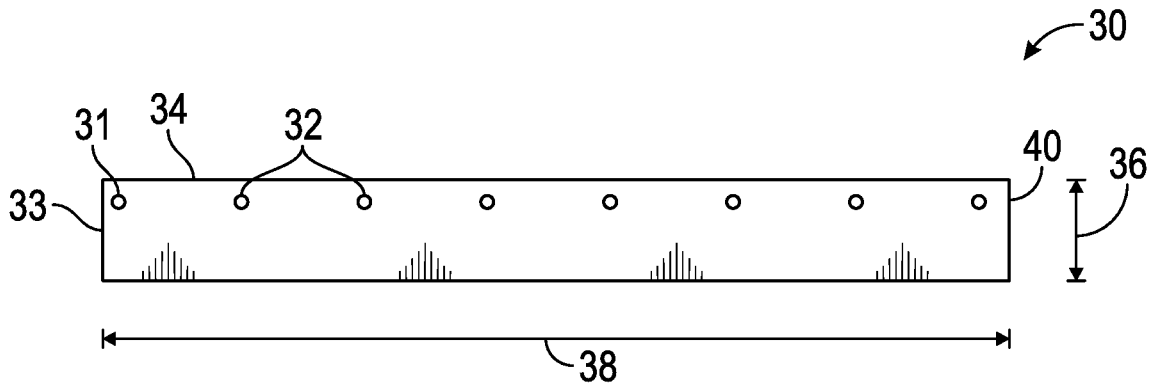
FIG. 2 illustrates a first embodiment of a protective strip.

Referring to FIG. 2 a protective strip 30 is shown. The protective strip 30 is made of a flexible material and has a generally rectangular shape. In one embodiment, the flexible material is vinyl. A first permanent magnet 31 is attached at a first end 33 of the protective strip 30. Additional permanent magnets 32 are attached along an edge 34 of the protective strip 30. The magnets 32 may be evenly spaced along the edge 34. In one embodiment, the magnets 32 are sewn in to the flexible material of the protective strip 30. In another embodiment, the magnets 32 are bonded to the flexible material. In one embodiment, magnets are spaced every twelve inches. In other embodiments, however, the magnets may be spaced closer together or further apart, depending upon the specific application. The magnets 32 are attachable to an object, such as a base 28 of a shelving unit 20, to removably secure the protective strip 30.

In an embodiment, the protective strip 30 is sized such that it will fit beneath the base deck 26 of the shelving unit 20 and a floor. In one embodiment, the width 36 of the strip 30 is about four inches. In another embodiment, the width 36 of the strip 30 is about six inches. In an embodiment, the length 38 of the flexible material is about 50 feet.

Figure 3:
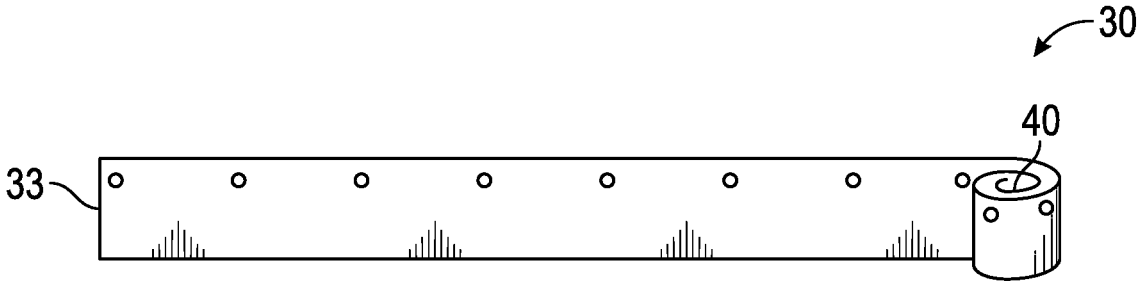
FIG. 3 illustrates a protective strip in a rolled condition.

The protective strip 30 may be designed such that it can be rolled about an end 40, as shown in FIG. 3. Rolling the protective strip 30 may make it easy to transport and attach to a shelving unit 20 or other fixture.

Figure 4:
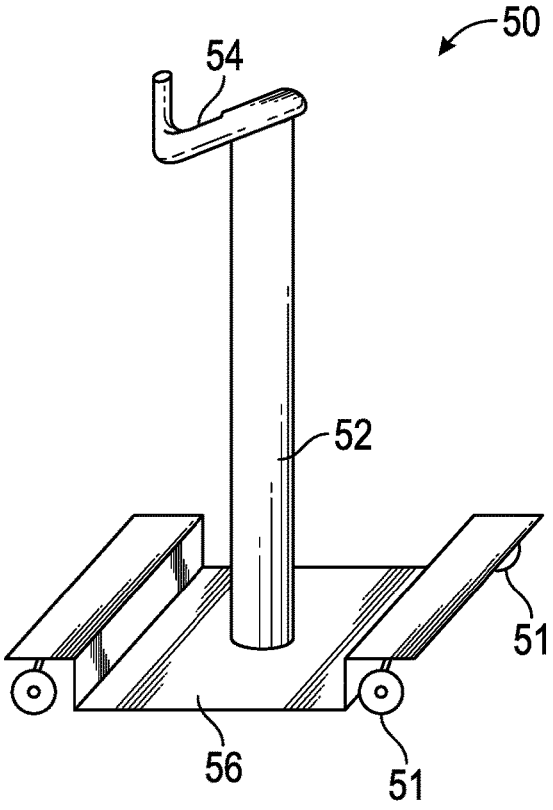
FIG. 4 illustrates a first embodiment of a cart.

FIG. 4 illustrates a cart 50 designed to hold the protective strip 30 when it is rolled up. The cart 50 has wheels 51 and a vertical member 52 attached to a base 56, and configured to hold the protective strip 30. In one embodiment, a user secures an end 40 of the protective strip 30 to the vertical member 52, and rotates the vertical member 52 such that the protective strip 30 is wrapped around the vertical member 52. A handle 54 may be used to facilitate the rotating of the vertical member 52. In another embodiment, the protective strip 30 may be rolled about an end 40 before being loaded onto the cart 50, and then slid onto the vertical member 52. In one embodiment, a base 56 of the cart 50 is ⅛ inch from the ground.

Figure 5:
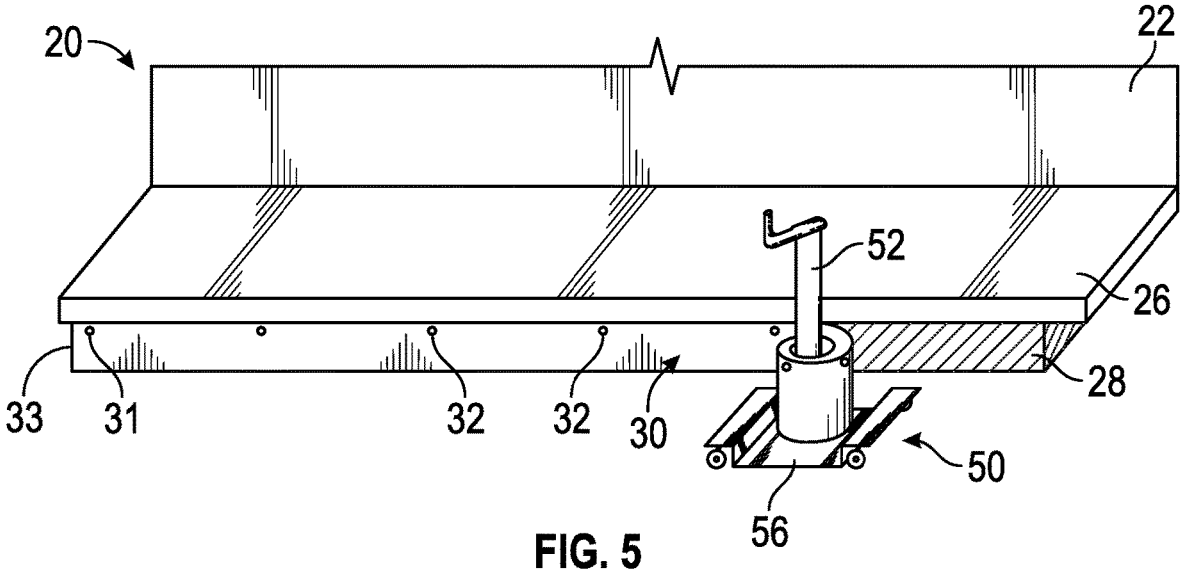
FIG. 5 illustrates a protective strip being attached to a shelving unit.

FIG. 5 illustrates a method of using the cart 50 to facilitate the attachment of the protective strip 30 to a shelving unit 20. A first end 33 of the protective strip 30 is attached to the base 28 of the shelving unit 20 with the first magnet 31. The cart 50 is then rolled along a length of the shelving unit 20, such that the protective strip 30 is unrolled from the vertical member 52, and the magnets 32 attach to the base 28. In a preferred embodiment, the edge 34 is adjacent the base deck 26 when the protective strip 30 is attached to the shelving unit 20.

The protective strip 30 is unrolled until either the end of the shelving unit 20 is reached, or the protective strip 30 runs out, at which point an additional protective strip 30 may be used to cover the remainder of the shelving unit 20. The magnets 31 and 32 allow for the protective strip 30 to be attached to the base 28 more quickly than known methods that use tape or clips. The protective strip 30 protects the base 28 of the shelving unit 20 from dents and scratches that may be caused by machinery used for caring for the floor.

In some applications, the protective strip 30 may be attached to the shelving unit 20 such that it is in contact with the floor, and the protective strip 30 creates a seal with the floor around the base 28 of the shelving unit 20. In this scenario, the protective strip 30 may also protect the floor from water, waste water, chemicals, concrete slurry and other cleaning fluids flowing underneath the shelving unit 20. In this embodiment, the protective strip 30 prevents fluids from staining or corroding the floor underneath the shelving unit 20.

Figure 6:
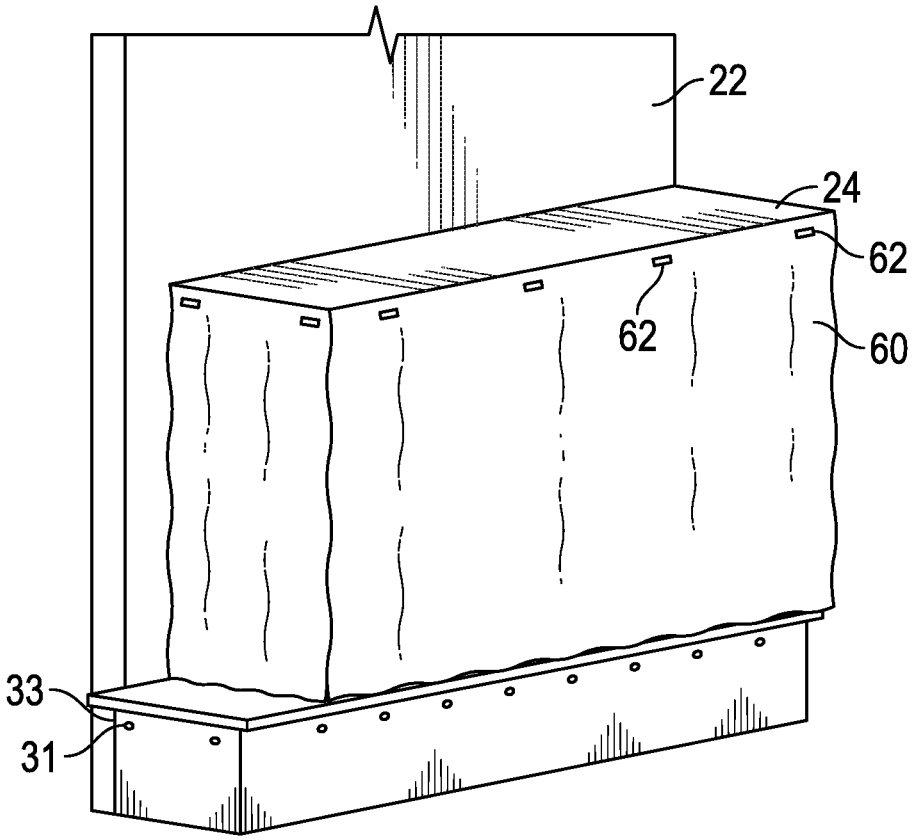
FIG. 6 illustrates another embodiment of a protective strip being attached to a shelving unit.

In another embodiment, a plastic sheet may be attached to the shelving unit 20 using the protective strip 30, as illustrated in FIG. 6. For applications in which it is desirable to protect items on the shelving unit 20, a plastic sheet 60 may be attached to an edge of the shelf 24 using attachment means 62. In one embodiment, attachment means 62 are magnets. In another embodiment, attachment means 62 are clips. After the plastic sheet 60 is attached to the shelf 24, the protective strip 30 is attached to the base 28, such that a lower edge of the plastic sheet 60 is captured between the base 28 and the protective strip 30. The protective strip 30 secures the lower edge of the plastic sheet 60, such that items on the shelving unit are protected from bumps from machinery or any fluids or dust that occurs from floor maintenance.

Figure 7:
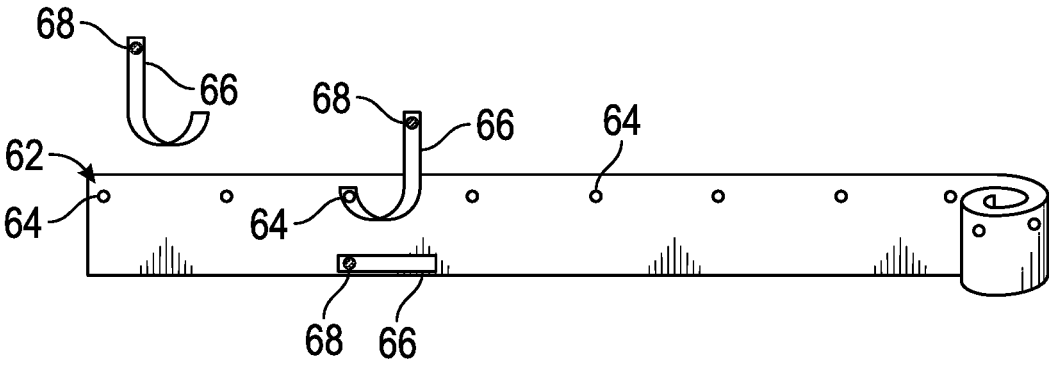
FIG. 7 illustrates another embodiment of a protective strip being.

FIG. 7 shows an alternative embodiment for securing a protective strip 62. The protective strip 62 is the same as the protective strip 30, except as described below. The protective strip 62 includes eyelets 64 or apertures adjacent an upper edge thereof. Securing ties or strips 66 include a magnet 68 secured or embedded at one end. The strip 66 can be looped through the eyelet 64 and then secured back to the strip 66 via hook and loop fasteners (e.g. Velcro™), snaps, buttons, or just tied back. Alternatively, the strip 66 can directly connect to the protective strip 62 via hook and loop fasteners (e.g. Velcro™), snaps, buttons or the like. The magnets 68 can then be secured to the shelving unit 20 (FIG. 6) as before. One securing strip 66 is connected to each eyelet 64.

As another alternative, the securing strips 66 can be used to secure the bottom of the protective strip 62. The securing strips 66 may be placed directly on top of the bottom edge of the protective strip 62. The securing strip 66 makes it easier to remove the magnet 68 later.

Figure 8:
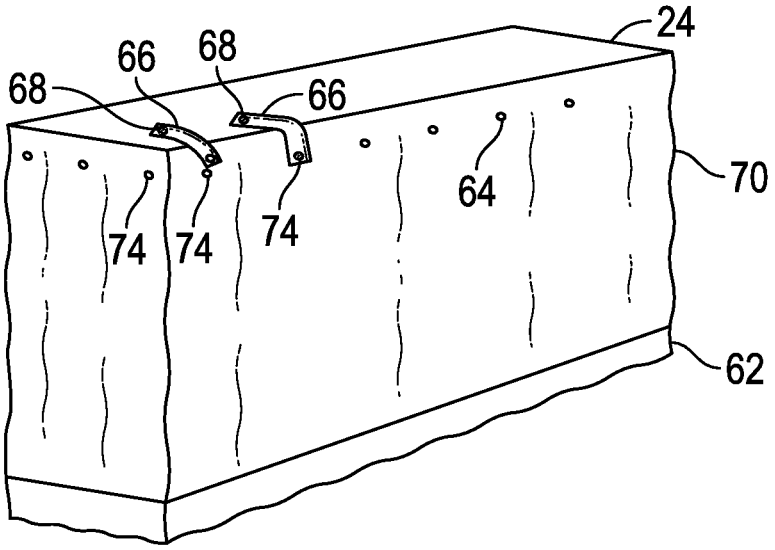
FIG. 8 illustrates another embodiment of a protective sheet and the protective strip of FIG. 7 attached to a shelving unit.

Referring to FIG. 8, as another alternative, the securing strips 66 can be used secure the sheet 60 to the shelving unit 20 (FIG. 6). If eyelets 74 are added to the sheet 60, the the securing strips 66 again loop through the eyelets 64. Alternatively, the securing strips 66 can be simply placed on the sheet 60 such that the magnets 68 secure the sheet 60 to the shelving unit 20.

Although the different examples have a specific component shown in the illustrations, embodiments of this disclosure are not limited to those particular combinations. It is possible to use some of the components or features from one of the examples in combination with features or components from another one of the examples. Also, although particular step sequences are shown, described, and claimed, it should be understood that steps may be performed in any order, separated or combined unless otherwise indicated and will still benefit from the present disclosure.

Furthermore, the foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A method of protecting a shelving unit, comprising:

attaching a first end of a protective strip to a base of a shelving unit using a first magnet, wherein the base of the shelving unit rests on a floor;

unrolling the protective strip, and attaching additional magnets to the base of the shelving unit; and attaching a plastic sheet to a first shelf of the shelving unit spaced above an upper surface of a base deck of the base of the shelving unit, such that a lower edge of the plastic sheet is captured between the base of the shelving unit and the protective strip.

2. The method as recited in claim 1, further including a step of moving a cart on the floor along the base of the shelving unit while unrolling the protective strip from the cart.

3. The method as recited in claim 2, wherein a base of the cart has a ⅛ inch clearance from the floor and wherein the cart has wheels on the floor supporting the base.

4. The method as recited in claim 1, wherein the protective strip is vinyl.

5. The method as recited in claim 1, wherein the first magnet and additional magnets are evenly spaced along a first edge of the protective strip.

6. The method as recited in claim 1, wherein an edge of the protective strip abuts the floor.

7. The method as recited in claim 1, wherein the plastic sheet is attached to the first shelf using magnets.

8. The method as recited in claim 1 wherein the step of attaching a first end of the protective strip includes the step of attaching the first end of the protective strip to a substantially vertical surface of the base.

9. The method as recited in claim 8 further including the step of attaching the protective strip to the base such that the protective strip is below a base deck of the base of the shelving unit.

10. A method of protecting a shelving unit, comprising:

positioning a rolled protective strip supported on a cart adjacent a base of a shelving unit supported on a floor;

attaching a portion of the protective strip to a vertical front surface of the base;

moving the cart on the floor along the front surface of the base while unrolling the protective strip and attaching the protective strip to the front surface of the base of the shelving unit.

11. The method of claim 10 wherein the step of attaching the protective strip to the front surface of the base is performed using magnets.

12. The method as recited in claim 11, wherein the step of attaching the protective strip includes attaching the protective strip so that a lower edge of the protective strip abuts the floor on which the base of the shelving unit rests.

13. The method as recited in claim 10 further including the step of attaching the protective strip to the base such that the protective strip is below a base deck of the base of the shelving unit.

14. The method of claim 13 wherein the step of attaching the protective strip to the front surface of the base is performed using magnets.

* * * * *